United States Patent [19]

Wilson

[11] 3,999,760

[45] Dec. 28, 1976

[54] SOLITAIRE CHECKER GAME

[76] Inventor: Frank E. Wilson, 1161 Sharlow Circle, Englewood, Fla. 33533

[22] Filed: Sept. 22, 1975

[21] Appl. No.: 615,470

[52] U.S. Cl. ..... 273/133; 273/131 AB

[51] Int. Cl.[2] ..... A63F 3/00

[58] Field of Search ..... 273/153, 131, 133

[56] References Cited

UNITED STATES PATENTS

| | | | |
|---|---|---|---|
| 591,737 | 10/1897 | Camburn | 273/133 X |
| 1,497,087 | 6/1924 | Butler et al. | 273/131 BA |

*Primary Examiner*—Delbert B. Lowe
*Attorney, Agent, or Firm*—Clarence A. O'Brien; Harvey B. Jacobson

[57] ABSTRACT

A game board with two sets of side-by-side rows of color designated spaces and the rows of one set of spaces crossed relative to the rows of the other set of rows is provided. Alternating spaces of each row are of two different colors and the crossed rows are arranged whereby the color of the spaces at the intersections of each pair of crossed rows coincides with the alternate color spacing of these rows. A plurality of game pieces equal in number to at least one less than the total number of the spaces of one color on the game board are provided and positionable on a corresponding number of the spaces of one color preparatory to the start of the game. The game is played by successive movement of the pieces to jump an adjacent piece for removal thereof until only one game piece remains on the board.

3 Claims, 2 Drawing Figures

10
12
14
16
17
18
2

SOLITAIRE CHECKER GAME

BACKGROUND OF THE INVENTION

The solitaire checker game of the instant invention has been designed to provide a game playable by a single person and yet which will involve a considerable amount of skill as opposed to card solitaire. When a person plays a card solitaire a considerable portion of the game insofar as its ultimate success is concerned involves luck in the order of the cards to be initially placed down on a playing surface and turned up during the game.

The solitaire checker game of the instant invention may be played with a varying number of game pieces, the game pieces may be placed upon the spaces of the game board in various manners and each game played from an initial placement of the game pieces on the board may be played differently. Accordingly, the variations possible with the solitaire checker game of the instant invention are substantially unlimited insofar as the memory of a single player is concerned.

BRIEF DESCRIPTION OF THE INVENTION

The solitaire checker game of the instant invention has been designed to provide and has as its main object the provision of a game which may be played by a single person and require considerable skill on the part of the person playing the game in order that a game may be successfully completed.

Another object of this invention is to provide a solitaire game which will be of a type familiar to any person who has played checkers and which therefore may be readily played by elderly persons wishing to play conventional checkers and waiting for a partner with whom to play conventional checkers.

A final object of this invention to be specifically enumerated herein is to provide a solitaire checker game in accordance with the preceding objects and which will conform to conventional forms of manufacture, be of simple construction and interesting to play so as to provide a device that will be economically feasible, long lasting and entertaining.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 2:
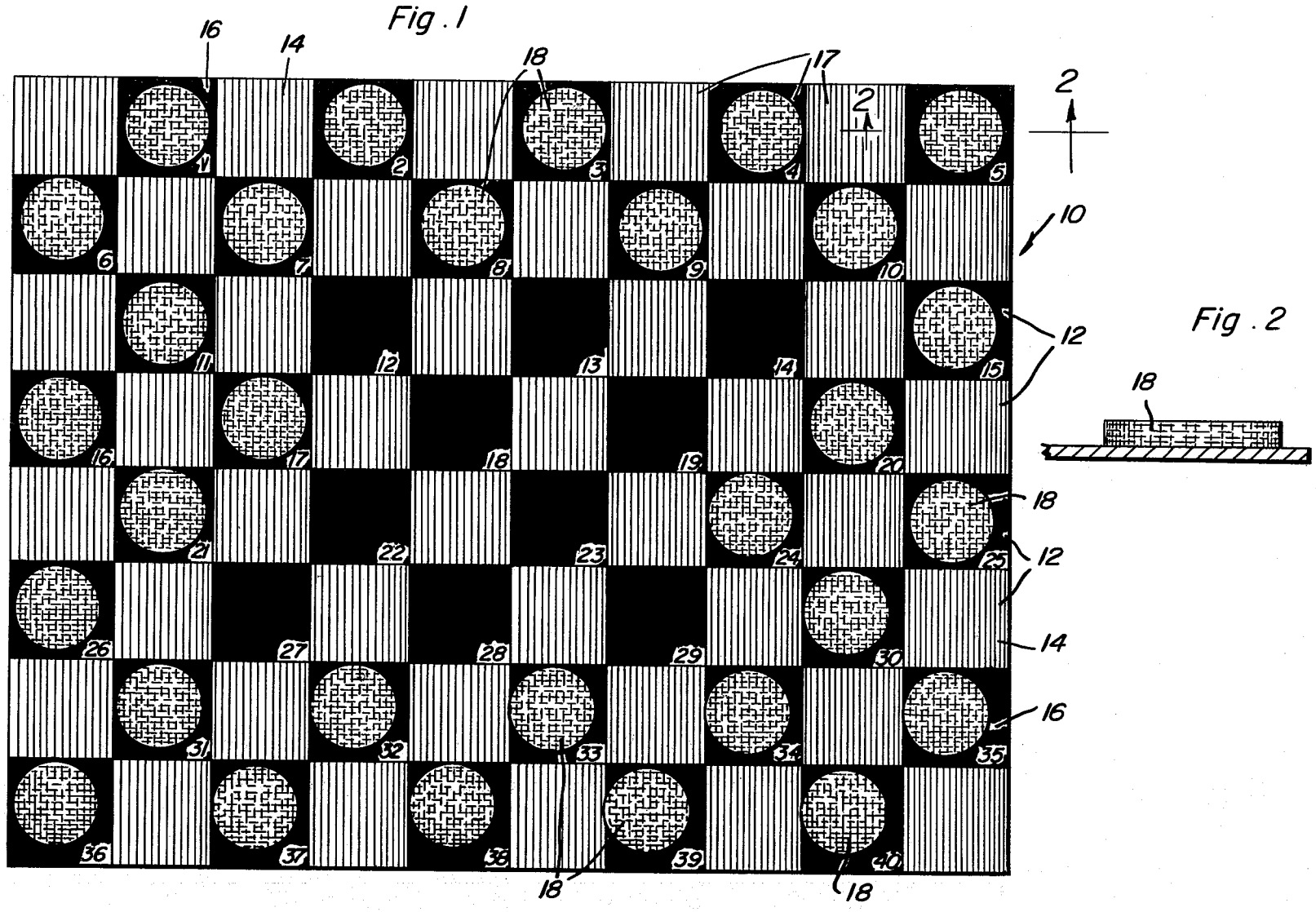
FIG. 1 is a plan view of the game board of the instant invention with a predetermined number of game pieces disposed thereon preparatory to initial play of the game.
FIG. 2 is an enlarged fragmentary vertical sectional view taken substantially upon the plane indicated by the section line 2—2 of FIG. 1.

Referring now more specifically to the drawings, the numeral 10 generally designates a game board of rectangular configuration and which may be constructed of reinforced cardboard or any other suitable material. Further, the game board 10 may be constructed of board halves joined together for relative folding whereby the board may be folded and stored in a plane area approximately one-half the plane area of the game board when open.

The game board 10 includes eight horizontal side-by-side rows 12 of spaces 14 and 16 which cross at right angles relative to ten vertical rows 17 of spaces 14 and 16.

In each of the rows 12 and 17, the spaces 14 and 16 alternate in color between red and black, respectively. Further, each pair of rows 12 and 17 which cross each other are arranged so that the space defined at the intersection of the two crossed rows coincides with the alternate spaced coloring of the spaces in those two rows.

The black spaces are independently numbered with successive numbers 1–40 beginning with the upper left-hand black space 16 with the numbers of the spaces 16 ascending to the right.

A plurality of game pieces 18 are provided in the form of cylindrical discs colored yellow. If the black spaces 16 are to be used as the spaces on the game board 10 upon which the game pieces 18 may be played and onto which the game pieces 18 may be moved, the game pieces 18 are all placed upon black spaces 16. The number of game pieces 18 may comprise any number at least one less than the number of black spaces 16. With all of the game pieces 18 placed upon the black spaces 16, the game is then started by jumping one of the game pieces over an adjacent game piece and landing in an unoccupied space 16. The piece jumped is always removed from the board and the game is continued with each move of a selected game piece comprising a jump over an adjacent game piece which is then removed from the board. Moves of selected pieces to jump other pieces are continued until such time as only one game piece 18 remains.

With attention now invited more specifically to FIG. 1 of the drawings, thirty game pieces 18 are disposed on the black spaces numbered 1, 2, 3, 4, 5, 6, 7, 8, 9, 10, 11, 15, 16, 17, 20, 21, 24, 25, 26, 30, 31, 32, 33, 34, 35, 36, 37, 38, 39 and 40. Although each initial arrangement of the game pieces 18 on the black spaces 16 may be successfully played, the following comprises two successful successions of moves of the game pieces 18 to complete the game;

I. Space 5 to space 10, space 36 to space 31, space 38 to space 33, space 24 to space 29, space 37 to space 32, space 33 to space 28, space 27 to space 22, space 1 to space 7, space 12 to space 18, space 16 to space 11, space 2 to space 7, space 3 to space 8, space 17 to space 12, space 4 to space 9, space 15 to space 20, space 40 to space 34, space 29 to space 24, space 25 to space 30, space 39 to space 34, space 35 to space 30, space 20 to space 14, space 8 to space 13, space 24 to space 19, space 9 to space 13, space 23 to space 18, space 26 to space 21, space 12 to space 17, space 6 to space 11, and space 21 to space 17.

II. Space 36 to space 31, space 5 to space 10, space 1 to space 7, space 38 to space 33, space 24 to space 29, space 4 to space 9, space 15 to space 20, space 40 to space 34, space 25 to space 30, space 39 to space 34, space 29 to space 24, space 35 to space 30, space 37 to space 32, space 33 to space 28, space 8 to space 13, space 20 to space 14, space 24 to space 19, space 9 to space 13, space 17 to space 12, space 16 to space 11, space 2 to space 7, space 6 to space 11, space 22 to space 17, space 26 to space 21, space 3 to space 8, space 11 to space 17, space 12 to space 18, space 27 to space 22, and space 23 to space 18.

Of course, the above two successful solutions to the game comprise solutions only to the game when the pieces 18 are arranged in the manner illustrated in FIG. 1 at the start of the game. Additionally, a greater number of game pieces 18 may be used before the start of the game and a lesser number of game pieces 18 may be used before the start of the game. It is envisioned that certain initial placements of a lesser number of game pieces 18 on the game board 10 may provide a more difficult game to complete.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A solitaire checker game comprising a substantially rectangular game board with two sets of adjacent side-by-side rows of color designated spaced, the rows of one set of rows being crossed relative to the rows of the other set of rows, alternating spaces of each row being of two distinctly different colors and the crossed rows being arranged whereby the color of the spaces at the intersections of each pair of crossed rows coincides with the alternate color spacing of these rows, a single set of game pieces of the same color, different from the first mentioned colors, and equal in number to at least one less than the total number of the spaces of one color on said game board, said game pieces being positionable on a corresponding number of said spaces of one color preparatory to the start of said game, said pieces being successively movable by a single player with each piece moved only to jump an adjacent piece for removal thereof until only one game piece remains on said board.

2. The combination of claim 1 wherein the number of game pieces is equal to at least two-thirds the total number of spaces of said one color on said board.

3. The combination of claim 1, wherein said one set of rows includes eight rows of ten spaces each and the other set of rows includes ten rows of eight spaces each.

* * * * *